US005787529A

United States Patent [19]

Landes

[11] Patent Number: 5,787,529

[45] Date of Patent: Aug. 4, 1998

[54] RESCUE CARRIER DEVICE

[76] Inventor: Raymond J. Landes, 6560 5th Ave. S., St. Petersburg, Fla. 33707

[21] Appl. No.: 937,011

[22] Filed: Sep. 24, 1997

[51] Int. Cl.[6] ..... A61G 1/01

[52] U.S. Cl. ..... 5/628; 5/627

[58] Field of Search ..... 5/625, 626, 627, 5/628, 925, 926; 294/140

[56] References Cited

U.S. PATENT DOCUMENTS

| | | | |
|---|---|---|---|
| 618,274 | 1/1899 | Jones | 5/627 |
| 2,788,530 | 4/1957 | Ferguson | 5/628 |
| 3,829,914 | 8/1974 | Treat | 5/625 X |
| 4,283,068 | 8/1981 | Keyser | 5/628 X |
| 4,442,557 | 4/1984 | Clemens | 5/625 |
| 5,189,740 | 3/1993 | Horie | 5/628 X |

*Primary Examiner*—Michael F. Trettel

[57] ABSTRACT

A rescue carrier device including a generally pear shaped sheet member. The sheet member is formed of a heat resistant material and adapted for receiving an immobile body. The sheet member has a front side and a back side. The sheet member has a left peripheral edge, a right peripheral edge, a top peripheral edge and a bottom peripheral edge. Also, a pair of support strips are attached to the front side of the sheet member. An elongated securing harness is fixedly attached to the front side of the sheet member in a continuous fashion so as to be adjacent the right peripheral edge and the left peripheral edge. An upper body restraining means is stitchedly attached juxtapose the front side of the sheet member. The upper body restraining means has a first end with a female coupling member and a second end with a male coupling member for coupling with the female coupling member. A pair of short straps are provided and form a left strap and a right strap. The left strap projects angularly outward from the upper body restraining means, the right strap projects angularly outward from the upper body restraining means. Lastly, a waist strap is spaced from the upper body restraining means and stitchedly attached to the front side of the sheet member.

9 Claims, 2 Drawing Sheets

RESCUE CARRIER DEVICE

BACKGROUND OF THE INVENTION

1. Field of the Invention

The present invention relates to a rescue carrier device and more particularly pertains to providing a flame retardant device for removal of a person, supine due to injury, from an unsafe environment to a safe environment.

2. Description of the Prior Art

The use of a body carrier is known in the prior art. More specifically, body carriers heretofore devised and utilized for the purpose of transporting rescued persons are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,386,604 to Ricketts discloses a patient rescue bag that is provided with an upper portion and a lower portion, with an insuative core, for use in carrying an injured person from a remote location that is not accessible by normal emergency vehicles.

U.S. Pat. No. 4,778,033 to Gonzalez discloses a rescue device that includes two adjustable strap members with an aluminum buckle attached to each strap member, and a spring closure latched disposed within one of the buckles to engage the other buckle.

U.S. Pat. No. 4,736,474 to Moran, Switlik, G, Switlik, S. Switlik, R. and Fanjul discloses a rescue transportation device that has an inflatable support member, an extended main section, an inclined section adjacent to one end of the main section extending upwardly and outwardly, a cover that extends about the inflatable support member, a mesh head restraint device and a plurality of body restraining device.

U.S. Pat. No. 4,625,335 to Vinai discloses a rescue and securing harness integrally affixed to a garment and is comprised of a strap section running down the users backbone, two oblique strap-sections which surround the user's chest, and two sections running along the user's groin-lines.

U.S. Pat. No. 4,442,557 to Clemens discloses a carrier apparatus, formed of a flaccid material and having a length sufficient to carry an adult victim, for fire fighters to used to carrier fire hose and personnel.

Lastly, U.S. Pat. No. 4,124,908 to Burns and Day discloses a rescue and transportation device that is constructed of cloth-like material and has a bottom portion with a head end, a foot end and a pair of side flaps.

In this respect, the rescue carrier device according to the present invention substantially departs from the conventional concepts and designs of the prior art, and in so doing provides an apparatus primarily developed for the purpose of providing a flame retardant device for removal of a person, supine due to injury, from an unsafe environment to a safe environment.

Therefore, it can be appreciated that there exists a continuing need for a new and improved rescue carrier device which can be used for providing a flame retardant device for removal of a person, supine due to injury, from an unsafe environment to a safe environment. In this regard, the present invention substantially fulfills this need.

SUMMARY OF THE INVENTION

In view of the foregoing disadvantages inherent in the known types of body carriers now present in the prior art, the present invention provides an improved rescue carrier device. As such, the general purpose of the present invention, which will be described subsequently in greater detail, is to provide a new and improved rescue carrier device which has all the advantages of the prior art and none of the disadvantages.

To attain this, the present invention essentially comprises a generally pear shaped sheet member. The sheet member is formed of a heat resistant material and adapted to receive an immobile body. The sheet member has a front side and a back side. The sheet member has a left peripheral edge, a right peripheral edge, a top peripheral edge and a bottom peripheral edge. Two strips of reflective material are fixedly attached to the back side of the sheet member. The back side has a coating of polytetrafluorethylene for drag reduction.

Also, an elongated securing harness is fixedly attached to the front side of the sheet member. The securing harness is attached in a continuous fashion so as to be adjacent the right peripheral edge and the left peripheral edge. The securing harness has a pair of harness end extents and forms a handle portion. Each of the pair of harness end extents extending beyond the bottom peripheral edge of the sheet member, with one crossed over another for permanent coupling of each at the cross over point. Each of the pair of harness end extents has a male coupling component.

An upper body restraining means is stitchedly attached juxtapose the front side of the sheet member. The upper body restraining means has a first end with a female coupling member. The upper body restraining means has a second end with a male coupling member. The female coupling member couples with the male coupling member when the upper body restraining means is positioned over the upper torso of the immobile body for selective restraint.

Included are a pair of short straps. Each strap has a free end and an attached end. The pair of short straps form a left strap and a right strap. The left strap projects angularly outward from the upper body restraining means. The right strap projects angularly outward from the upper body restraining means. Each free end of the pair of short straps has a female coupling component for engaging one of the male coupling components of the securing harness. This coupling allows restraint of the lower torso of the immobile body.

Lastly, a waist strap is spaced from the upper body restraining means and stitchedly attached to the front side of the sheet member. The waist strap has a left strap end and a right strap end. The left strap end has a left female coupler and the right strap end has a right male coupler. The left female coupler engages the right male coupler for allowing the waist strap to support the back of the immobile body during transport within the sheet member.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved rescue carrier device which has all the advantages of the prior art body carriers and none of the disadvantages.

It is another object of the present invention to provide a new and improved rescue carrier device which may be easily and efficiently manufactured and marketed.

It is a further object of the present invention to provide a new and improved rescue carrier device which is of a durable and reliable construction.

An even further object of the present invention is to provide a new and improved rescue carrier device which is susceptible of a low cost of manufacture with regard to both materials and labor, and which accordingly is then susceptible of low prices of sale to the consuming public, thereby making such rescue carrier device economically available to the buying public.

Still yet another object of the present invention is to provide a new and improved rescue carrier device which provides in the apparatuses and methods of the prior art some of the advantages thereof, while simultaneously overcoming some of the disadvantages normally associated therewith.

Still another object of the present invention is to providing a flame retardant device for removal of a person, supine due to injury, from an unsafe environment to a safe environment.

Lastly, it is an object of the present invention to provide a new and improved rescue carrier device that has a generally pear shaped sheet member. The sheet member is formed of a heat resistant material and adapted for receiving an immobile body. The sheet member has a front side and a back side. The sheet member has a left peripheral edge, a right peripheral edge, a top peripheral edge and a bottom peripheral edge. Also, a pair of support strips are attached to the front side of the sheet member. An elongated securing harness is fixedly attached to the front side of the sheet member in a continuous fashion so as to be adjacent the right peripheral edge and the left peripheral edge. An upper body restraining means is stitchedly attached juxtapose the front side of the sheet member. The upper body restraining means has a first end with a female coupling member and a second end with a male coupling member for coupling with the female coupling member. A pair of short straps are provided and form a left strap and a right strap. The left strap projects angularly outward from the upper body restraining means, the right strap projects angularly outward from the upper body restraining means. Lastly, a waist strap is spaced from the upper body restraining means and stitchedly attached to the front side of the sheet member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
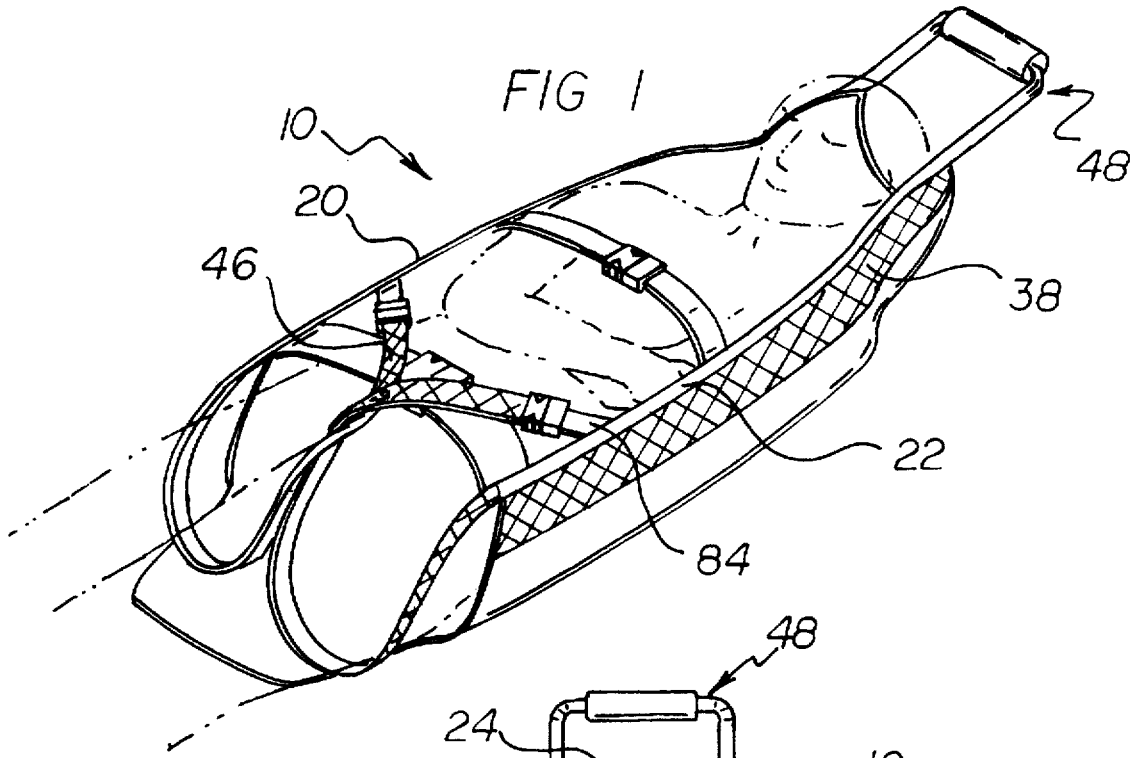
FIG. 1 is a perspective illustration of the preferred embodiment of the rescue carrier device constructed in accordance with the principles of the present invention.

With reference now to the drawings, and in particular to FIG. 1 thereof, a new and improved rescue carrier device embodying the principles and concepts of the present invention and generally designated by the reference numeral 10 will be described.

The present invention, the new and improved rescue carrier device, is comprised of a plurality of components. Such components in their broadest context include a sheet member, a securing harness, a upper body restraining means and a handle. Such components are individually configured and correlated with respect to each other so as to attain the desired objective.

More specifically, it will be noted that the present invention has a generally pear shaped sheet member 12. The sheet member is formed of a heat resistant material and adapted to receive an immobile body. The material used to make the sheet member is either Kevar™ or Nomex™. These fabrics are used because the device's intended use will be by fire fighters and in hot environments. The sheet member has a front side 14 and a back side 16. The sheet member has a left peripheral edge 20, a right peripheral edge 22, a top peripheral edge 24 and a bottom peripheral edge 26. The back side has a coating of polytetrafluorethylene 28 for drag reduction. The front side may be coated with polytetrafluorethylene.

The pear shape of the sheet member forms a head area 32. The head area, as shown in FIG. 1, is able to keep the head in alignment with the spine of the body positioned on the sheet member. Also, the sheet member has an lower section 34 that provides a resting area for the posterior of the immobile body when positioned on the sheet member.

Figure 3:
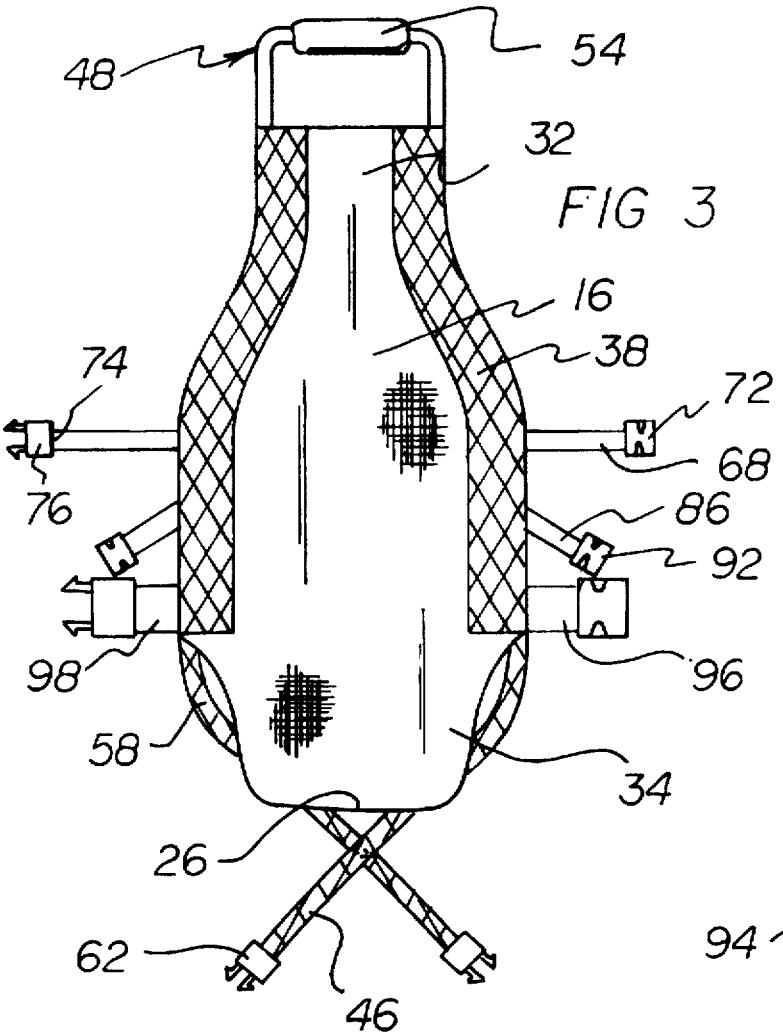
FIG. 3 is bottom plan view of the rescue carrier device of FIG. 1.
Figure 4:
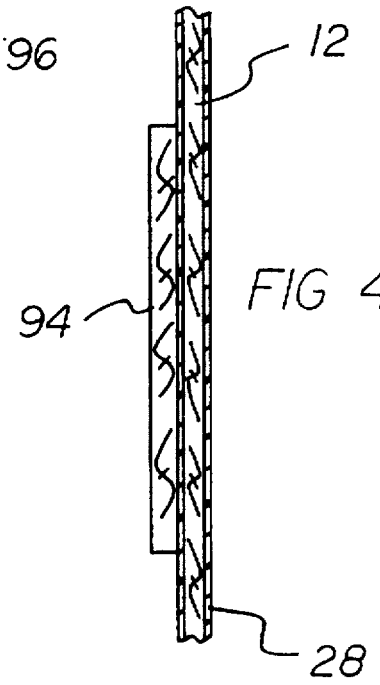
FIG. 4 is a cut-away cross-sectional view taken along line 4—4 of FIG. 2.

As best illustrated in FIG. 3, two strips 38 of reflective material are provided. The strips are fixedly attached to the back side 16 of the sheet member, as shown in FIG. 3.

Figure 2:
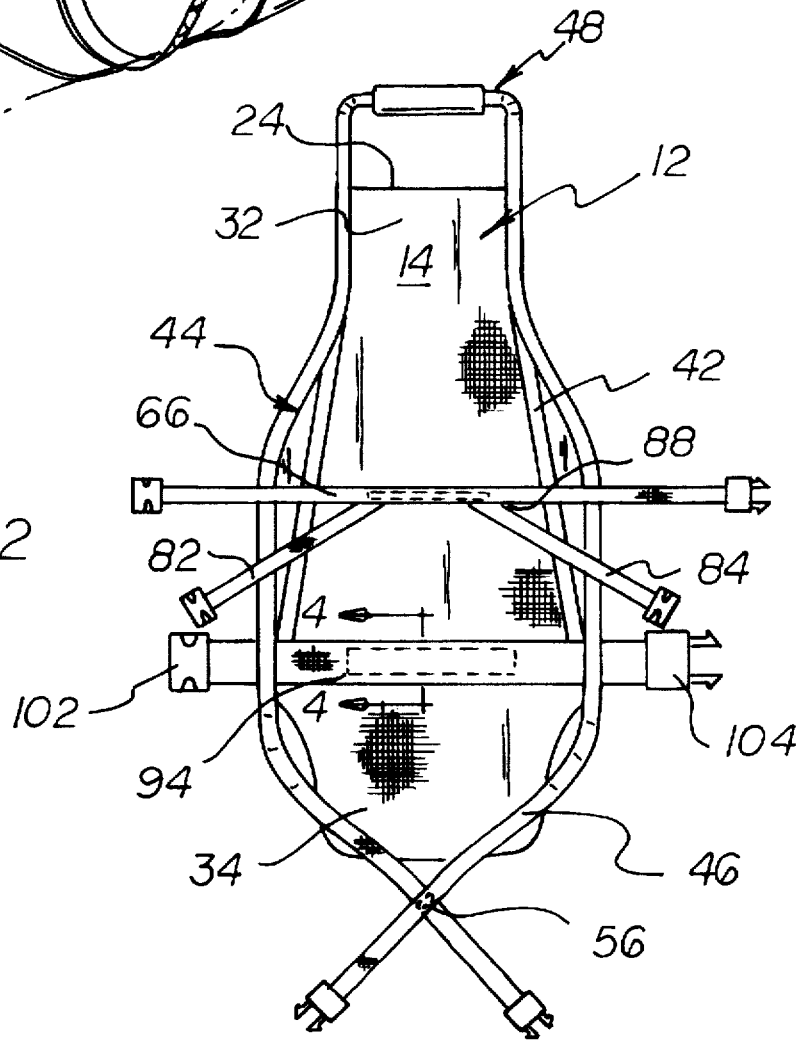
FIG. 2 is top plan view of the rescue carrier device of FIG. 1.

Included are a pair of support strips 42. As shown in FIG. 2, the pair of support strips are attached to the front side 14 of the sheet member. Each of the pair of support strips are spaced apart. One of each of the pair of strips is spaced from the left peripheral edge 20 and another is spaced from the right peripheral edge 22. The pair of support strip provide fold controls for the sheet member.

Also, an elongated securing harness 44 is fixedly attached to the front side 14 of the sheet member 12. The securing harness, as depicted in FIG. 2 is formed of Kevar™ webbing. The securing harness is attached to the sheet member in a continuous fashion so as to be adjacent the right peripheral edge and the left peripheral edge. The securing harness has a pair of harness end extents 46 and forms a handle portion 48.

The handle portion is spaced from the top peripheral edge of the sheet member. The handle has a reinforced wrapping 54 of Kevar™ for strength. The handle portion is used by the fire fighter to tow the immobile body on the sheet member.

Each of the pair of harness end extents, as seen in FIGS. 2 and 3, extending beyond the bottom peripheral edge of the sheet member. One of the pair of harness end extents crosses over another of the pair of harness end extents for permanent coupling of each at the cross over point 56. Each of the pair of harness end extents have reflective material on a harness upper side 58. Each of the pair of harness end extents has a male coupling component 62.

Additionally, an upper body restraining means 66 is stitchedly attached juxtapose the front side 12 of the sheet member. The upper body restraining means has a first end 68 with a female coupling member 72. The upper body restraining means has a second end 74 with a male coupling member 76. The female coupling member couples with the male coupling member, as shown in FIG. 1, when the upper body restraining means is positioned over the upper torso of the immobile body for selective restraint. Coupling of the upper body restraining means draws the left and right peripheral edge of the sheet member toward each other. The drawing in of the left and right peripheral edge of the sheet member allows the sheet member to enfold along the pair of support strips 42.

Included are a pair of short straps 82 and 84. Each strap has a free end 86 and an attached end 88. The pair of short straps form a left strap 82 and a right strap 84. As seen in FIG. 2, the left strap projects angularly outward from the upper body restraining means. As seen in FIG. 2, the right strap projects angularly outward from the upper body restraining means. Each free end of the pair of short straps has a female coupling component 92 for engaging one of the male coupling components 62 of the securing harness. This coupling allows restraint of the lower torso of the immobile body. The pair of harness end extents are pulled between the leges and over the groin area, as shown in FIG. 1, to couple with the pair of short straps. The coupling of the securing harness with the pair of short straps draws the sheet member in more and forms and envelopes the immobile body like a partial cocoon.

Lastly, a waist strap 94 is spaced from the upper body restraining means and stitchedly attached to the front side of the sheet member 12. The waist strap has a greater width than the upper restraining means 66 and the pair of short straps. The waist strap has a left strap end 96 and a right strap end 98. The left strap end has a left female coupler 102 and the right strap end has a right male coupler 104. The left female coupler engages the right male coupler for allowing the waist strap to support the back of the immobile body during transport within the sheet member.

Figure 5:
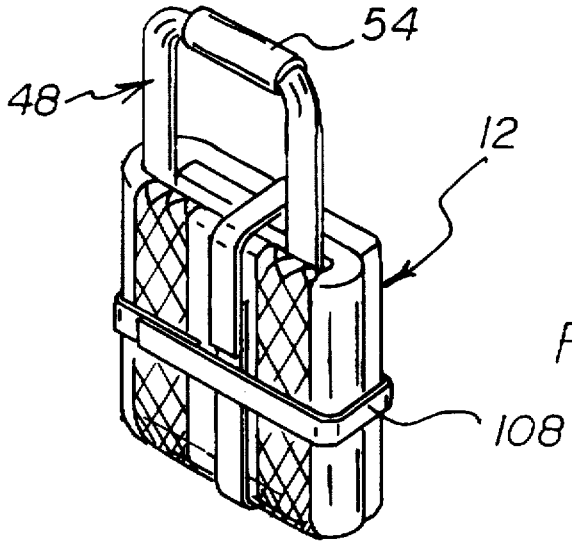
FIG. 5 is an isometric view of the present invention in a folded configuration.

Furthermore, when the rescue carrier device is not in use it is folded for carrying with the handle. As shown in FIG. 5, the sheet member is folded into a generally rectangular member. The various retraining components of the invention are folded within the sheet member. A pair of closing straps 108 are use to secure the folded device.

The present invention rescue carrier device for the easy transport of an immobile person to a safe location is a aide for firefighters. The primary usage of the invention is for at least one firefighter to quickly, safely and efficiently remove an immobile body from a dangerous area. In use the immobile body is log rolled onto the sheet member and quickly strapped in by the various restraining components. The sheet member of the rescue carrier device has a head area tailored to keep the head and neck in line with the spine during movement. The handle is situated in order to raise the head and shoulders off the ground for safe and easy removal from almost any angle and above the plane of the ground. The waist strap is fastened first. The harness extents of the securing harness are then placed across the front plane of the immobile body, with the harness extents criss crossing to fasten with the short straps. Finally, the upper restraining means is fastened. Once the various restraining components are coupled about body the fire fighter is ready do drag the body to safety. The sheet member is coated to allow the device to slide easily across any hot or cold surface.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved rescue carrier device for the easy transport of an immobile person to a safe location comprising, in combination:

a generally pear shaped sheet member being formed of a heat resistant material and adapted for receiving an immobile body, the sheet member having a front side and a back side, the sheet member having a left peripheral edge, a right peripheral edge, a top peripheral edge and a bottom peripheral edge, two strips of reflective material being fixedly attached to the back side of the sheet member, the back side having a coating of polytetrafluorethylene for drag reduction;

an elongated securing harness being fixedly attached to the front side of the sheet member in a continuous fashion so as to be adjacent the right peripheral edge and the left peripheral edge, the securing harness having a pair of harness end extents and forms a handle portion, each of the pair of harness end extents extending beyond the bottom peripheral edge of the sheet member with one being crossed over another for permanent coupling of each at the cross over point, each of the pair of harness end extents having a male coupling component;

an upper body restraining means being stitchedly attached juxtapose the front side of the sheet member, the upper body restraining means having a first end with a female coupling member, the upper body restraining means having a second end with a male coupling member, the female coupling member couples with the male coupling member when the upper body restraining means being positioned over the upper torso of the immobile body for selective restraint;

a pair of short straps with each strap having a free end and an attached end, the pair of short straps forming a left strap and a right strap, the left strap projecting angularly outward from the upper body restraining means, the right strap projecting angularly outward from the upper body restraining means, each free end of the pair of short straps having a female coupling component for engaging one of the male coupling components of the securing harness for allowing restraint of the lower torso of the immobile body; and a waist strap being spaced from the upper body restraining means and stitchedly attached to the front side of the sheet member, the waist strap having a left strap end and a right strap end, the left strap end having a left female coupler and the right strap end having a right male coupler, the left female coupler engages the right male coupler for allowing the waist strap to support the back of the immobile body during transport within the sheet member.

2. A rescue carrier device comprising:

a generally pear shaped sheet member being formed of a heat resistant material and adapted for receiving an immobile body, the sheet member having a front side and a back side, the sheet member having a left peripheral edge, a right peripheral edge, a top peripheral edge and a bottom peripheral edge;

a pair of support strips attached to the front side of the sheet member;

an elongated securing harness being fixedly attached to the front side of the sheet member in a continuous fashion so as to be adjacent the right peripheral edge and the left peripheral edge;

an upper body restraining means being stitchedly attached juxtapose the front side of the sheet member, the upper body restraining means having a first end with a female coupling member and a second end with a male coupling member for coupling with the female coupling member;

a pair of short straps forming a left strap and a right strap, the left strap projecting angularly outward from the upper body restraining means, the right strap projecting angularly outward from the upper body restraining means; and a waist strap being spaced from the upper body restraining means and stitchedly attached to the front side of the sheet member.

3. The rescue carrier device as set forth in claim 2, further including two strips of reflective material being fixedly attached to the back side of the sheet member, and the back side having a coating of polytetrafluorethylene for drag reduction.

4. The rescue carrier device as set forth in claim 2, wherein the securing harness having a pair of harness end extents and forms a handle portion, and each of the pair of harness end extents extending beyond the bottom peripheral edge of the sheet member with one being crossed over another for permanent coupling of each at the cross over point.

5. The rescue carrier device as set forth in claim 4, wherein each of the pair of harness end extents having a male coupling component.

6. The rescue carrier device as set forth in claim 2, wherein the upper body restraining means being positioned over the upper torso of the immobile body for selective restraint when the female coupling member and the male coupling member are releasably joined.

7. The rescue carrier device as set forth in claim 5, wherein each strap of the pair of short straps having a free end and an attached end, the pair of short straps, each free end of the pair of short straps having a female coupling component for engaging one of the male coupling components of the securing harness for allowing restraint of the lower torso of the immobile body.

8. The rescue carrier device as set forth in claim 2, wherein the waist strap having a left strap end and a right strap end, the left strap end having a left female coupler and the right strap end having a right male coupler, the left female coupler engages the right male coupler for allowing the waist strap to support the back of the immobile body during transport within the sheet member.

9. A rescue carrier device comprising, in combination:

a generally pear shaped sheet member being formed of a heat resistant material and adapted for receiving an immobile body, the sheet member having a front side and a back side, the sheet member having a left peripheral edge, a right peripheral edge, a top peripheral edge and a bottom peripheral edge;

an elongated securing harness being fixedly attached to the front side of the sheet member in a continuous fashion so as to be adjacent the right peripheral edge and the left peripheral edge, the securing harness having a pair of harness end extents and forms a handle portion, each of the pair of harness end extents extending beyond the bottom peripheral edge of the sheet member with one being crossed over another for permanent coupling of each at the cross over point, each of the pair of harness end extents having a male coupling component;

an upper body restraining means being stitchedly attached juxtapose the front side of the sheet member, the upper body restraining means having a first end with a female coupling member, the upper body restraining means having a second end with a male coupling member, the female coupling member couples with the male coupling member when the upper body restraining means being positioned over the upper torso of the immobile body for selective restraint; and a pair of short straps with each strap having a free end and an attached end, each free end of the pair of short straps having a female coupling component for engaging one of the male coupling components of the securing harness for allowing restraint of the lower torso of the immobile body.

* * * * *